US005947317A

United States Patent [19]

Hall

[11] Patent Number: 5,947,317

[45] Date of Patent: Sep. 7, 1999

[54] OPENER FOR BEVERAGE CONTAINERS

[76] Inventor: John R. Hall, 38 Willow La., New Hartford, Conn. 06057

[21] Appl. No.: 09/039,689

[22] Filed: Mar. 16, 1998

Related U.S. Application Data

[60] Provisional application No. 60/041,150, Mar. 17, 1997.

[51] Int. Cl.[6] ..... B65D 17/34

[52] U.S. Cl. ..... 220/269

[58] Field of Search ..... 220/269

[56] References Cited

U.S. PATENT DOCUMENTS

| | | | |
|---|---|---|---|
| 4,114,778 | 9/1978 | O'Neal | 220/267 |
| 4,207,781 | 6/1980 | Greenwood . | |
| 4,524,646 | 6/1985 | Kimberlin, Jr. . | |
| 4,617,842 | 10/1986 | Yang . | |
| 4,720,022 | 1/1988 | Gomes | 220/269 |
| 5,335,808 | 8/1994 | Lee | 220/269 |
| 5,555,778 | 9/1996 | Otters et al. . | |
| 5,715,964 | 2/1998 | Turner et al. | 220/269 |
| 5,749,488 | 5/1998 | Bagwell et al. | 220/269 |
| 5,813,561 | 9/1998 | Chang et al. | 220/269 |

*Primary Examiner*—Stephen K. Cronin
*Attorney, Agent, or Firm*—William C. Crutcher

[57] ABSTRACT

A lift-up tab opener for a beverage can is improved by providing an actuator with a finger loop and pressure tab to push open a closure tab as in the prior art. The actuator is modified to elevate the pressure tab with a bend forming a fulcrum, so that the pressure tab can be pushed to elevate the finger loop for ease of grasping it to operate the actuator.

7 Claims, 2 Drawing Sheets

OPENER FOR BEVERAGE CONTAINERS

CROSS REFERENCE TO RELATED APPLICATIONS

This application claims the benefit of prior filed co-pending provisional application Ser. No. 60/041,150 filed Mar. 17, 1997.

BACKGROUND OF THE INVENTION

This invention relates to openers for beverage containers, and more particularly to an improved lift-up tab opener of the type commonly used for cans of soda, beer or the like.

In a known prior art type of construction, the central section of the beverage can end is provided with a weakened score line which defines a generally U-shaped closure tab portion configured to be broken from the can end and forced by downward pressure into the interior of the can. This produces an oval-shaped opening through which the contents of the can may be dispensed. A generally elongated actuator is hingedly attached to the central portion of the can top end by means of a rivet. One end of the actuator is provided with a nose or pressure tab which overlies the U-shaped closure tab portion, so that when a finger loop on the opposite or terminal end of the actuator is lifted away from the can end, the pressure tab is forced downwardly to bend the U-shaped closure tab portion into the interior of the can.

Prior to opening, the actuator is pressed tightly against the can end by the rivet. Consequently, to initially lift the finger loop end away from the can end it is necessary to insert a fingernail or other object between the finger loop end and the can end. Since a fair degree of force must be exerted to cause the pressure tab to break the U-shaped portion from the can end, there is always the danger of breaking a fingernail during the opening process.

A prior art container is shown in plan view in FIG. 1 comprising a container 1 with a top 2 seamed by a crimped peripheral edge 2*a* and a central section 2*b* including a partially scored U-shaped closure tab 3. Tab 3 is adapted to be severed from top 2 along a major portion of its peripheral edge when pressure is exerted downward against the closure tab. The pressure is exerted by lifting one end of an actuator shown generally at 4, which is attached to top 2 by a rivet 5. The actuator 4 includes a central holding lip 6, which is attached to top 2 by rivet 5 just outside the periphery of tab 3. One end of the actuator comprises a pressure tab 7 positioned above closure tab 3 and the other end of the actuator 4 comprises a finger loop 8 which is grasped and lifted.

Several types of tools have been disclosed in the prior art to assist in operating the lift-up tab openers, examples being shown in U.S. Pat. No. 4,253,352 issued Mar. 3, 1981 to O'Neal and U.S. Pat. No. 4,524,646 issued Jun. 25, 1985 to Kimberlin.

Referring to the cross section of prior art FIG. 2, the actuator 4 is shown lying flat against top 2. In order to assist in lifting the ring finger loop 8, the tops of beverage cans often include an indentation 2*c* to assist in getting the fingernail under the edge of finger loop 8. In spite of this, lifting the actuator sometimes results in broken fingernails or difficulty in starting the lifting process for finger loop 8. FIG. 3 illustrates the prior art lift-up tab actuator 4 after it has been rotated about the rivet to bend the holding lip 6 to depress the pressure tab 7 against the closure tab 3 to open the container.

The object of the present invention is to provide an improved lift-up tab opener which facilitates safely and easily opening a beverage container without need for special tools.

SUMMARY OF THE INVENTION

Briefly stated, the invention comprises an improved lift-up tab opener for a beverage container of the type having a wall with an upper peripheral edge and a top having a central section and an outer edge sealingly attached to the wall upper peripheral edge to provide a peripheral rim projecting above the central section, the central section defining a closure tab adapted to be partially severed from the central section along a scoring line when pressed inwardly to open the beverage container, an actuator having a pressure tab near one end thereof and a finger loop on the other end thereof, a central holding lip extending from a junction near the pressure tab end and defined and separated from the rest of the actuator by an arcuate opening, and connector means attaching the actuator central holding lip to the central section of the beverage container adjacent the closure tab so that the finger loop lies adjacent the central section.

The improvement in the prior art comprises fulcrum means interposed between the opposite ends of the actuator which is arranged to elevate the pressure tab away from the central section, so that it is spaced from the central section while the finger loop lies adjacent the central section, the fulcrum means being located and arranged to cause the finger loop to rise from the central section when the pressure tab end of the actuator is pressed toward the central section.

In its preferred form, the invention is practiced by providing an actuator of the type described above, having the pressure tab bent upwardly at a slight angle, the bend being located between the pressure tab end of the actuator and a rivet serving as connecting means. The bend provides a fulcrum for the actuator, so that by pressing down on the pressure tab, the opposite finger loop end of the actuator is lifted away from the container top to enable the finger tip to enter the finger loop and thereafter operate the actuator in the conventional manner.

DRAWINGS

FIG. 1 is a plan view of the top of a prior art beverage container,

FIG. 2 is an elevational view in cross section, taken along lines II—II of FIG. 1 illustrating the prior art, FIG. 3 is an elevational view in cross section similar to FIG. 2, showing the prior art beverage container after it has been opened, FIG. 4 is a plan view of my improved opener for a beverage container, FIG. 5 is an elevational view in cross section, taken along lines V—V of FIG. 4, FIG. 6 is an elevational view in cross section similar to FIG. 5 illustrating the invention during the first phase of opening the beverage container, and FIG. 7 is an elevational view similar to FIGS. 5 and 6 illustrating the opened beverage container.

DESCRIPTION OF THE PREFERRED EMBODIMENT

Figure 1:
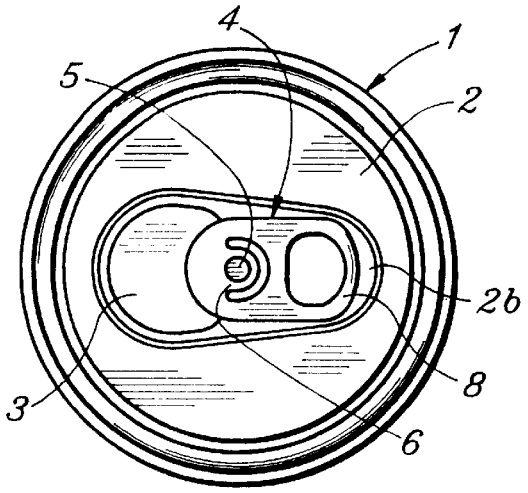
Fig. 1 (Prior Art)
Figure 4:
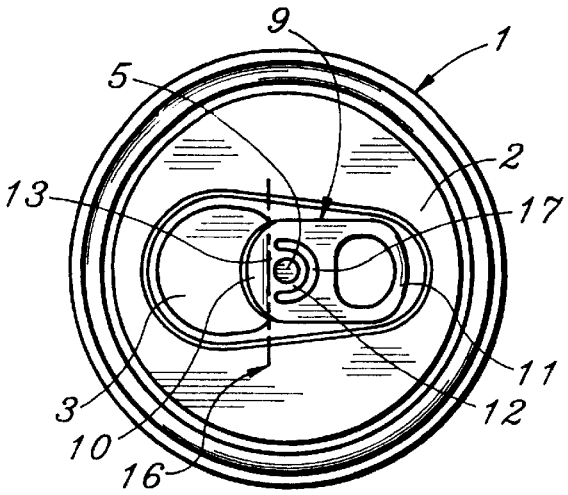

The beverage container 1 includes a top 2 with a peripheral outer edge 2*a* and a central section 2 with a scored tab 3 as before. An actuator 9 includes a pressure tab 10 on one end and a finger loop 11 on the other end as before. A rivet 5 passes through a central holding lip 12 to attach the actuator 9 to the beverage container top 2. The central holding lip 12 extends from a junction 16 near the pressure tab end and is defined and separated from the rest of the actuator by an arcuate opening 17.

Figure 2:
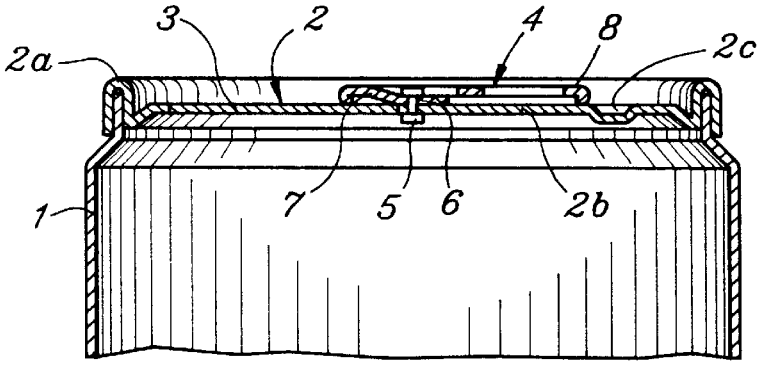
Fig. 2 (Prior Art)
Figure 3:
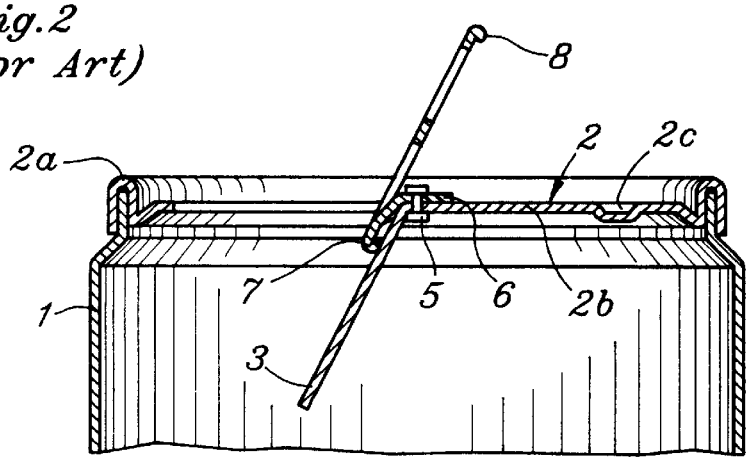
Fig. 3 (Prior Art)
Figure 5:
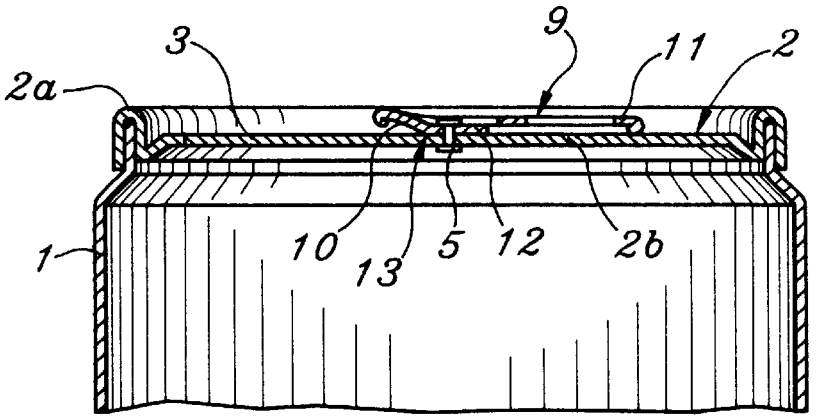

In accordance with the present invention, the end of actuator 9 with the pressure tab 10 is bent upwardly away from the central section of the beverage container top 2 at a slight angle to provide a fulcrum point indicated by arrow 13. The central section of the beverage can is flat and does not require an indentation similar to 2*c*, in FIGS. 2 and 3, although an indentation may be provided if desired. Pressure tab 10 should not be bent so sharply that the end of tab 10 extends beyond the top of the beverage can. Only a slight bend is necessary to achieve the benefits of the invention, on the order of 10–20 degrees from the plane of the actuator.

OPERATION

Figure 6:
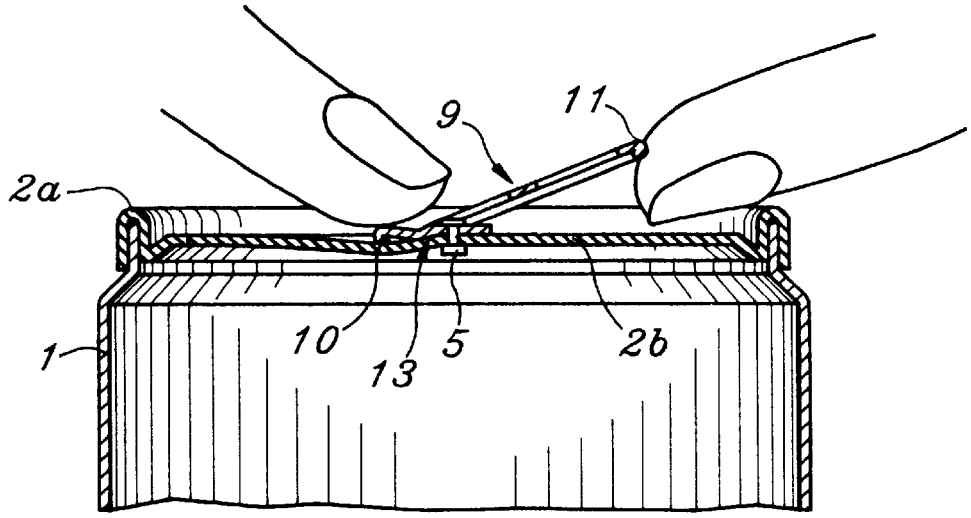
Figure 7:
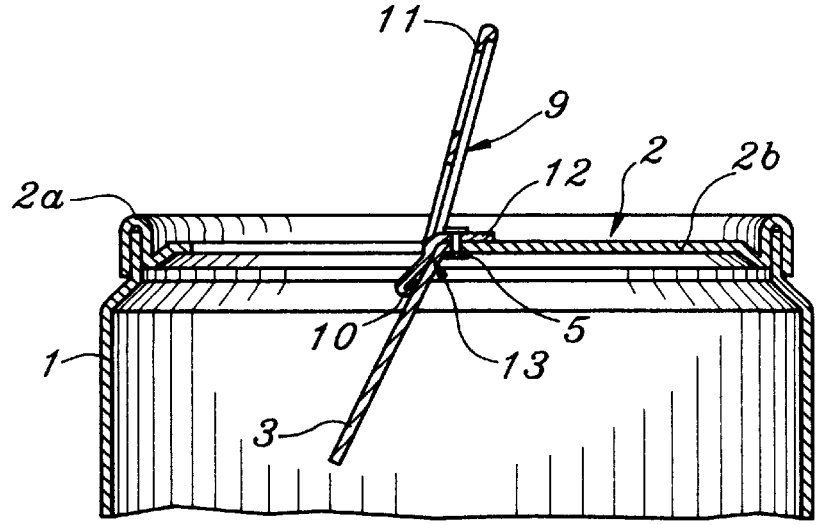

Reference to FIGS. 6 and 7 illustrate the operation of the invention. The first phase of the opening process is shown in FIG. 6, and comprises pressing down with a finger or thumb 14 on the pressure tab 10. This causes rotation of the actuator 7 around fulcrum 13 and slight lifting of the opposite finger loop 11. Flexibility of top 2 of the beverage can assists this action, as shown in FIG. 6. While maintaining pressure on tab 10, another finger 15 can be easily inserted beneath the elevated finger loop 11. The second phase of the opening process is indicated in FIG. 7, by continuing to raise the finger loop 11 of the actuator so as to cause the pressure tab 10 to push against and tear the scored periphery of the closure tab 3. Because of the bend in the pressure tab, it is necessary to lift the finger loop slightly higher than before. This does not materially affect the opening process.

Other variations in the actuator to provide fulcrum means may be made within the scope of the present invention. Instead of bending the actuator, a separate fulcrum piece may be attached to the underside of the actuator at the location of arrow 13.

Therefore a very slight change in the configuration of the prior art actuator results in a dramatic change in utility. The invention facilitates opening a beverage container without the possible injury or inconvenience experienced with the present type of lift-up tab actuator, and without the use of special tools.

I claim:

1. An improved lift-up tab opener for a beverage container having a wall with an upper peripheral edge and a top having a central section and an outer edge sealingly attached to the wall upper peripheral edge to provide a peripheral rim projecting above the central section, the central section defining a closure tab adapted to be partially severed from the central section along a scoring line when pressed inwardly to open the beverage container, an actuator having a pressure tab near one end thereof and a finger loop on the other end thereof, the actuator having a central holding lip extending from a junction near the pressure tab end and defined and separated from the actuator by an arcuate opening and connector means attaching the actuator central holding tab to the central section of the beverage container adjacent the closure tab so that the finger loop lies adjacent the central section, the improvement comprising:

fulcrum means interposed between the ends of the actuator near said junction and arranged to elevate the pressure tab away from the central section, so that it is spaced from the central section while the finger loop lies adjacent the central section, said fulcrum means being located and arranged to cause the finger loop to rise from the central section when the pressure tab end of the actuator is pressed toward the central section.

2. The improvement according to claim 1, wherein the fulcrum means elevates the pressure tab until it is just below said peripheral rim.

3. The improvement according to claim 1, wherein the finger loop end and the pressure tab end of the actuator are each substantially flat and are inclined to one another near said junction so as to provide said fulcrum means.

4. An improved lift-up tab opener for a beverage container having a wall with an upper peripheral edge and a top having a central section and an outer edge sealingly attached to the wall upper peripheral edge to provide a peripheral rim projecting above the central section, the central section defining a closure tab adapted to be partially severed from the central section along a scoring line when pressed inwardly to open the beverage container, an actuator defining an arcuate opening near a first end thereof and a finger loop on the other end thereof, said actuator including a pressure tab on said first end and a flexible central holding lip extending from a junction near the pressure tab end and defined and separated from the rest of the actuator by said arcuate opening, and connector means attaching the actuator central holding lip to the central section of the beverage container adjacent the closure tab so as to also tend to hold the finger loop end of the actuator pressed against the central section of the beverage container, the improvement comprising:

at least one bent section in said actuator disposed between the end of the pressure tab and the connector means, said bent section extending substantially along said junction, said bent section arranged to elevate the pressure tab away from the central section, so that it is spaced from the central section while the finger loop lies adjacent the central section, said bent section arranged to bear on the central section so as to act as a fulcrum for elevating the finger loop while the central holding lip flexes at said junction when the pressure tab end of the actuator is pressed toward the central section.

5. The improvement according to claim 4, wherein the bent section elevates the pressure tab until it is just below said peripheral rim.

6. The improvement according to claim 4, wherein said bent section extends transversely across the actuator.

7. The improvement according to claim 4, wherein the finger loop end and the pressure tab end of the actuator are each substantially flat and are inclined to one another at an angle between 10 and 20 degrees at said bent section.

* * * * *